252-99 AU 165 EX
6/29/76 OR 3,966,627

United States Patent [19]

Gray

[11] 3,966,627

[45]*June 29, 1976

[54] DISHWASHING COMPOSITIONS

[75] Inventor: Frederick W. Gray, Summit, N.J.

[73] Assignee: Colgate-Palmolive Company, New York, N.Y.

[ * ] Notice: The portion of the term of this patent subsequent to Aug. 28, 1990, has been disclaimed.

[22] Filed: Jan. 17, 1975

[21] Appl. No.: 541,813

Related U.S. Application Data

[63] Continuation of Ser. No. 291,680, Sept. 25, 1972, abandoned.

[52] U.S. Cl. ..... 252/99; 252/DIG. 10; 252/89 R; 252/95; 252/135

[51] Int. Cl.[2] ..... C11D 7/56

[58] Field of Search ..... 252/99, 95, 135, 89, 252/DIG. 10

[56] References Cited

UNITED STATES PATENTS 3,758,180 8/1973 Austin ..... 252/99

*Primary Examiner*—Mayer Weinblatt
*Attorney, Agent, or Firm*—Steven J. Baron; Norman Blumenkopf; Herbert S. Sylvester

[57] ABSTRACT

A cleaning composition particularly adapted for washing dishes, glasses and silverware in mechanical devices such as automatic dishwashers and capable of inhibiting overglaze attack containing as an essential ingredient aluminum silicate.

8 Claims, No Drawings

DISHWASHING COMPOSITIONS

This is a continuation of application Ser. No. 291,680, filed 9/25/72, now abandoned, the benefit of which filing date is claimed.

The present invention relates in general to cleaning compositions and in particular to the provision of cleaning compositions beneficially adapted for use in connection with the cleaning of substrates such as dishwear and the like having a glazed surface.

Many of the cleaning compositions heretofore recommended for use in connection with the cleaning of substrates having a glazed surface have been subject to one or more significant disadvantages. Perhaps the paramount difficulty involved relates to the pronounced tendency of such compositions to attack or otherwise deleteriously affect substrates such as typified by glass, porcelain and the like, thereby leading to impairment of such articles. As will be recognized, aesthetic considerations rather than purely functional criteria are often of overriding importance as regards the suitability of a given cleaning composition and especially when contemplated for use in connection with the cleaning of fine china and the like having an ornamental or decorative surface. The magnitude of the problems encountered can be readily appreciated in view of the significant risk of economic loss entailed. Without intending to be bound by any theory it has nevertheless been hypothesized in explanation of the overglaze attack phenomenon that one or more of the ingredients present in the cleaning composition exhibit a pronounced if not intolerable tendency to attack the flux constituents present in the bonding material utilized in securing the decorative or ornamental pattern to the substrate and especially under the relatively severe alkaline conditions necessarily extant in the cleaning solution during actual use.

In an effort to overcome or otherwise ameliorate the foregoing and related difficulties, considerable research activity has been necessary in the development of cleaning compositions specifically and advantageously adapted to minimize the overglaze attack problem and yet capable of providing the requisite measure of cleaning activity.

Accordingly, it has now been discovered that the inclusion of a quantity of aluminum silicate in the detergent formulation surprisingly inhibits attack on the glaze on china. While the proportion of aluminum silicate in a detergent formulation may be varied, a desirable range is from a small but perceptible quantity to 3 % by weight of the total formulation, a preferred range being from approximately 1.5% by weight to approximately 2.5 % by weight of the total formulaton.

Thus, a primary object of the present invention resides in the provision of cleaning compositions substantially devoid of any tendency to attack the glazed surface of a wide variety of substrates.

Another object of the present invention resides in the provision of cleaning compositions capable of providing superior cleaning activity e.g., bleaching, washing, etc.

Other objects and advantages of the present invention will become more apparent hereinafter as the description proceeds.

In accordance with the present invention, a water-soluble alkaline detergent composition for automatic dishwashing comprises a major amount of inorganic builder salts such as alkali metal phosphates, silicates, carbonates, sulfates; a bleaching agent capable of liberating hypohalite in aqueous media; and aluminum silicate as an overglaze protector.

The inclusion of aluminum silicate in a dishwashing composition results in a formulation which is highly alkaline but nevertheless provides a relatively corrosion-free environment together with the additional feature of the elimination of the tendency to cause fading of designs and patterns on china. In addition, the composition retains its excellent cleaning powers. Undoubtedly, the utilization of aluminum silicate in other dishwashing formulations will be found and the present inventive concept should be considered in the widest aspects.

The aluminum silicate contemplated for use in the practice of the present invention and capable of inhibiting overglaze attack is a known material. All aluminum silicates, irregardless of the method of preparation, function as an effective overglaze protector in an alkaline dishwashing medium. A specific illustrative example comprises the addition of aluminum sulfate to a soluble silicate at about 140°F. The precipitated aluminum silicate has the composition $Al_2O_3 \cdot 7.8\ SiO_2$ and contains 15.6% free moisture, 0.83% sulfate, and a very small amount of sodium; it has a pH of 7.0, and a density of the packed composition of 0.4g/cc and a density of 0.23 g/cc of the loose composition (not tamped). Aluminum silicates having a pH in the range of 5–9 can also be prepared in accordance with the aforedefined procedure by adding a small amount of sodium aluminate to the aluminum sulfate and sodium silicate reaction mixture to obtain an aluminum silicate of the desired pH. Accordingly, it is apparent that conditions of reaction and reactants can be varied to obtain aluminum silicates having specific physical attributes, such as pH, density, degree of hydration, etc.

The water soluble builder salts utilized in the instant detergent compositions include the inorganic basic and neutral water soluble salts. The builder salt is employed in amounts ranging up to about 95%, i.e. 50–95% by weight with a range of from about 70% to about 90% by weight of the composition being preferred. Suitable builders include without necessary limitation, Trisodium phosphate
Tetrasodium pyrophosphate
Sodium acid pyrophosphate
Sodium tripolyphosphate hexahydrate
Sodium monobasic phosphate
Sodium dibasic phosphate
Sodium hexameta phosphate
Sodium silicates, $SiO_2/Na_2O$ of 1/1 to 3.2/1
Sodium carbonate
Sodium sulfate
Borax etc.

Suitable organic builders include salts of organic acids and, in particular, the water soluble salts of aminopolycarboxylic acids. The alkali metal salts such as sodium potassium and lithium; ammonium and subtituted ammonium salts such as methylammonium, diethanolammonium and triethanolammonium; and amine salts such as mono, di- and triethanolamine, methylamine, octylamino, diethylenetriamine, triethylenetetramine and ethylenediamine are efficacious. The acid portion of the salt can be derived from acids such as nitrilodiacetic; N-(2-hydroxyethyl) nitrilodiacetic acid, nitrilotriacetic acid (NTA), ethylenediamine tetracetic acid, (EDTA); N-(2-hydrooxyethyl) ethylene diamine triacetic acid; 2-hydroxyethyl iminodiacetic acid; 1, 2-diaminocyclohexanediacetic acid; diethylenetriamine penta-acetic acid and the like. The builder salt is preferably employed in amounts sufficient to yield a pH in water of from 9.5 to 12 preferably from 10 to 11. Particularly preferred compositions contain for example from about 55 to about 75% sodium tripolyphosphate hexahydrate and about 15 to about 25% sodium metasilicate as alkaline builder.

The cleaning compositions described herein may further be provided with one or more bleaching agents which may in general be defined as encompassing compounds capable of liberating a hypohalite such as hypochlorite chlorine and/or hypobromite bromine on contact with aqueous media. Particular examples of bleaching agents include the dry, particulate heterocyclic N-bromo and N-chloro imides such as trichlorocyanuric, tribromocyanuric acid, dibromo- and dichlorocyanuric acid, the salts thereof with water-solubilizing cations such as potassium and sodium. Such bleaching agents may be employed in admixtures comprising two or more, particularly efficacious bleaching agent in this regard comprising the material commercially available from the Monsanto Chemical Company under the trade name designation "ACL-66", ACL signifying "available chlorine" and the numerical designation "66", indicating the parts per pound of available chlorine. This particular product comprises a mixture of potassium dichloro-isocyanurate (4 parts) and trichloroisocyanuric acids (one part).

Other N-bromo and N-chloro imides may also be used, such as N-brominated and N-chlorinated succinimide, malonimide, phthalimide and naphthalimide. Other compounds include the hydantoins, such as 1,3-dibromo and 1,3-dichloro-5,5-dimethylhydantoin; N-monochloro-5,5-dimethylhydantoin, methylene-bis (N-bromo-5,5-dimethylhydantoin); 1,3-dibromo and 1,3-dichloro 5-isobutylhydantoin; 1,3-bromo and 1,3-dichloro, 5,methyl-5-n-amylhydantoin, and the like. Other useful hypohalite-liberating agents comprise tribromomelamine and trichloromelamine. Dry, particulate, water soluble anhydrous inorganic salts are likewise suitable for use such as lithium hypochlorite and hypobromite. The hypohalite-liberating agent may, if desired, be provided in the form of a stable, solid complex or hydrate, such as sodium p-toluene-sulfo-bromamine-trihydrate, sodium benzene-sulfo-chloramine-dihydrate, calcium hypobromite tetrahydrate, calcium hypochlorite tetrahydrate etc. Brominated and chlorinated trisodium phosphate formed by the reaction of the corresponding sodium hypohalite solution with trisodium phsophate (and water as necessary) likewise comprise efficacious materials. The present invention contemplates as an additional embodiment the use of bleaching agents capable of liberating hypochlorite as well as hypobromite such as, for example, the N-brominated, N'-chlorinated heterocyclic imides, as for example the N-bromo, N-chlorocyanuric acids and salts thereof, e.g., N-monobromo-N, N-dichloro-cyanuric acid, N-mono-bromo-N-monochlorocyanuric acid, sodium-N-monobromo-N-monochlorocyanurate, potassium-N-monobromo-N-monochlorocyanurate; and the N-brominated, N-chlorinated hydantoins, e.g., N-bromo-N-chloro-5,5-dimethylhydantoin and N-bromo-N-chloro-5-ethyl-5-methyl hydantoin.

The hypohalite-liberating compound is employed in an amount of from 0.5 to 5% by weight of the composition, and preferably in an amount of from about 0.5 to 3% by weight thereof. In any event, the hypohalide material should preferably be employed in amounts sufficient to yield from about 0.5–3% available chlorine, bromine, etc. in order to assure optimum results.

In general, efficacious cleaning compositions may be formulated in accordance with the present invention by the use of the aluminum silicate in amounts of about 0.5 to 3% by weight of total composition and up to about 95% i.e., from 40% to 95% by weight of at least one compound selected from the group of water-soluble organic detergent, water soluble neutral or alkaline builder salt, bleaching agent capable of liberating hypohalite on contact with aqueous media and caustic alkali. The bleaching agent is essential to the implementation of those embodiments of the present invention directed to industrial bottle cleaning compositions.

Water soluble organic detergents i.e., surface active components may be employed, such materials being well known in the prior art, the term detergent comprehending species of the anionic, cationic, amphoteric and zwitterionic types.

Thus, suitable anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or resin acids, such as may be derived from fats, oils, and waxes of animal, vegetable or marine origin, e.g., the sodium soaps of tallow, grease, coconut oil, tall oil and mixtures thereof; and the sulfated and sulfonated synthetic detergents, particularly those having about 8 to 26, and preferably about 12 to 22, carbon atoms to the molecule.

As examples of suitable synthetic anionic detergents there may be cited the higher alkyl mononuclear aromatic sulfonates such as the higher alkyl benzene sulfonates containing from 10 to 16 carbon atoms in the alkyl group in a straight or branched chain, e.g., the sodium salts of decyl, undecyl, dodecyl, (lauryl), tridecyl, tetradecyl, pentadecyl, or hexdecyl benzene sulfonate and the higher alkyl toluene, xylene and phenol sulfonates, alkyl naphthalene sulfonate, ammonium diamyl naphthalene sulfonate, and sodium dinonyl naphthalene sulfonates.

Other anionic detergents are the olefin sulfonates, including long chain alkene sulfonates, long chain hydroxyalkane sulfonates or mixtures of alkenesulfonates and hydroxyalkanesulfonates. These olefin sulfonate detergents may be prepared, in known manner, by the reaction of $SO_3$ with long chain olefins, (of 8–25, preferably 12–21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g., sodium bisulfite); e.g., primary paraffin sulfonates of about 10–20, preferably about 15–20, carbon atoms; sulfates of higher alcohols; salts of α-sulfofatty esters (e.g., of about 10–20 carbon atoms, such as methyl α-sulfomyristate or α-sulfotallowate).

Examples of sulfates of higher alcohols are sodium lauryl sulfate, sodium tallow alcohol sulfate. Turkey Red Oil or other sulfated oils, or sulfates of mono- or diglycerides of fatty acids (e.g. stearic monoglyceride monosulfate), alkyl poly (ethenoxy) ether sulfates such as the sulfates of the condensation products of ethylene oxide and lauryl alcohol (usually having 1 to 5 ethenoxy groups per molecule); lauryl or other higher alkyl glyceryl ethersulfonates; aromatic poly (ethenoxy) other sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g. sodium lauroylsarcosinate) the acyl esters (e.g. oleic acid ester) or isothionates, and the acyl N-methyl taurides (e.g. potassium N-methyl lauroyl- or oleyl tauride).

The most highly preferred water soluble anionic detergent compounds are the ammonium and substituted ammonium (such as mono-, di and triethanolamine), alkali metal (such as sodium and potassium) and alkaline earth metal (such as calcium and magnesium) salts of the higher benzene sulfonates, olefin sulfonates, the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols of monoesters of hexahydric alcohols and inner ethers thereof such as sorbitan monolaurate, sorbitol mono-oleate and mannitan monopalmitate, and the condensation products of polypropylene glycol with ethylene oxide.

Cationic surface active agents may also be employed. Such agents are those surface active detergent compounds which contain an organic hydrophobic group and a cationic solubilizing group. Typical cationic solubilizing groups are amine and quaternary groups.

As examples of suitable synthetic cationic detergents there may be noted the diamines such as those of the type $RNC_2H_4NH_2$ wherein R is an alkyl group of about 12 to 22 carbon atoms such as N-2-aminoethyl stearyl amine and N-2-aminoethyl myristyl amine; amido-linked amines such as those of the type $R^1CONHC_2H_4NH_2$ wherein $R^1$ is an alkyl group of about 9 to 20 carbon atoms, such as N-2-amino ethyl-stearyl amide and N-amino ethyl myristyl amide; quaternary ammonium compounds wherein typically one of the groups linked to the nitrogen atom are alkyl groups which contain 1 to 3 carbon atoms, including such 1 to 3 carbon alkyl groups bearing inert substituents, such as phenyl groups, and there is present an anion such as halogen, acetate, methosulfate, etc. Typical quaternary ammonium detergents are ethyl-dimethyl-stearyl ammonium chloride, benzyl-dimethyl-stearyl ammonium chloride, benzyl-dimethyl-stearyl ammonium bromide, trimethyl stearyl ammonium chloride, trimethyl-cetyl ammonium bromide, dimethyl-ethyl dilauryl ammonium chloride, dimethyl-propylmyristyl ammonium chloride, and the corresponding methosulfates and acetates.

Examples of specific amphoteric detergents are N-alkyl-beta-aminopropionic acid; N-alkyl-beta-iminodipropionic acid, and N-alkyl, N,N-dimethyl glycine; the alkyl group may be, for examples, that derived from coco fatty alcohol, lauryl alcohol, myristyl alcohol, (or a lauryl-myristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the betaines containing a sulfonic group instead of the carboxylic group; betaines in which the long chain substituent is joined to the carboxylic group without an intervening nitrogen atom, e.g. inner salts of 2-trimethylamino fatty acids such as 2-trimethylaminolauric acid, and compounds of any of the previously mentioned types but in which the nitrogen atom is replaced by phosphorus.

The detergent material is employed in concentrations ranging from about 0.5% to about 5% by weight of total composition with a range of 1% to 3% being particularly preferred.

Thus, a relatively minor amount of nonionic type detergent, that is, about 2–4% is especially beneficial inasmuch as it acts as a foam depressant as well as a detersive agent in an automatic dishwashing solution.

Minor amounts of other additives which do not interfere with the cleaning and overglaze protection properties of instant composition may be added such as pigments, dyes perfume, etc. In some instances it may be commercially feasible to add said ingredients to render them more attractive to the consumer.

The following examples are given for purposes of illustration only and are not to be considered as necessarily constituting a limitation on the present invention. All parts and percentages given are by weight unless otherwise indicated. For purposes of ascertaining the capacity of the various compositions exemplified to ameliorate overglaze Specialties on fine china samples, the method of the Chemical Specialities Manufacturers Association (CSMA) is employed such method being described in detail in "Soap and Chemical Specialties", 33, (9), 60, 1957. Such test is designed as an accelerated dishwasher exposure method; thus, the comparative removal of overglaze decoration provides direct means for affording an evaluation of the corrosiveness of dishwashing detergent solutions. According to such method, samples of standard plates (Greenwood pattern) Onondaga Pottery Co., Syracuse, New York) are immersed in deionized or distilled water maintained at a temperature of 211°F. and containing the indicated per cent concentration of detergent for periods of 2, 4 and 6 hours. The test samples are thereafter removed, hand-rubbed with cloth and compared with untreated samples of the same standard plate. The treated samples are visually scrutinized to determine the extent of overglaze damage with numerical indicia being assigned to indicate the extent of overglaze damage involved. Thus, the scale of 0, 1, 2, 3 and 4 correspond, in terms of damage, to none, slight, moderate, considerable and complete respectively.

EXAMPLE 1

This example illustrates the applicability of the present invention to the preparation and use of cleaning compositions specifically adapted for use in connection with dishwashing operations.

The following composition is prepared:

| % | Ingredients |
|---|---|
| 62.4 | Sodium tripolyphosphate hexahydrate |
| 20 | Sodium metasilicate |
| 2 | Wetting agent* |
| 1.6 | Potassium dichloroisocyanurate |
| 12 | Sodium sulfate |

*Long chain linear alcohol with ethylene oxide addition available under the trade name designation RA-35 from the Wyandotte Chemical Company.

To the above composition is added 2% aluminum silicate.

Overglaze damage is evaluated according to the CSMA method hereinbefore described utilizing an 0.3% aqueous solution of the above ingredients having a pH of about 11.0. The following results are obtained:

| Fine China Damage | | |
|---|---|---|
| 2 hrs. | 4 hrs. | 6 hrs. |
| 0 | 0 | 0 |

As the above data makes manifestly clear, no perceptible overglaze damage is detected despite immersion periods of the fine china standard plate samples ranging up to 6 hours. Of equal importance is the fact that such samples are substantially devoid of aluminum precipitate or other undesired material thereby yielding an aesthetically pleasing surface.

EXAMPLE 2

Example 1 is repeated except that the concentration of aluminum silicate is reduced to 1% by weight and the sodium sulfate is increased to 13% by weight. The results obtained are as follows:

| Fine China Damage | | |
|---|---|---|
| 2 hrs. | 4 hrs. | 6 hrs. |
| 0 | 1 | 2 |

These results show that by decreasing the amount of the aluminum silicate to 1%, slight to moderate overglaze attack is evident for long term immersions of 4 to 6 hours.

EXAMPLE 3

Example 1 is repeated except that the concentration of aluminum silicate is reduced to 0.5% by weight and the sodium sulfate content increased to 13.5% by weight. The results obtained are shown below.

| Fine China Damage | | |
|---|---|---|
| 2 hrs. | 4 hrs. | 6 hrs. |
| 0 | 2 | 3 |

The above results are indicative of the complete protection against overglaze attack for short immersion periods afforded by the presence of even very small amounts of aluminum silicate, on the order of 0.5% by weight of the total composition.

When the foregoing procedure is repeated but the aluminum silicate omitted, slight incipient overglaze attack is detected for immersion period of 2 hours, moderate attack after 4 hours immersion and complete attack after 6 hours immersion.

In addition, the exemplified procedures make unavoidably clear that the compositions provided in accordance with the present invention are capable of superior cleaning activity i.e., displaying an outstanding capacity to readily remove stain deposits from a wide variety of glazed dishware.

Effective industrial bottle cleaning compositions may be provided in accordance with the present invention by merely admixing with caustic alkali whereby to provide a highly alkaline composition preferably having a pH of about 12. Such compositions may be readily formulated in accordance with the parameters hereinbefore described.

Results similar to those described in the foregoing examples are obtained when the procedures delineated therein are repeated but employing in lieu of the specific non-ionic detergent identified a variety of materials selected from nonionic, anionic, cationic, amphoteric and zwitterionic types. Moreover, nothing critical resides in the selection of bleaching agent and accordingly, any of the materials hereinbefore recommended for such purposes may be readily employed to advantage.

While the detergent composition of the present invention finds most efficacious utilization in connection with the washing of the dishes and the like in automatic dishwashers, naturally, the detergent may be utilized in other fashions as desired. Usually, however, the best mode of use will be in connection with automatic dishwashers which have the ability of dispensing the detergent of the present invention in one or more separate wash cycles. Accordingly, the detergent compositions of the present invention is added to the two receptacles, if such are present, in an automatic dishwasher. When the dishwasher is set into operation, after the dishes have been suitably positioned therein, the automatic devices of the dishwasher permit the addition of sufficient water to produce a concentration of the detergent composition of approximately 0.3% by weight. The operation of the dishwasher results in treating, that is, washing of the dishes with the aqueous solution of the detergent composition. Usually, the sequence of operation in utilizing an automatic dishwasher results in one or more rinsing steps following the one or more washing cycles. In utilizing the detergent composition of the present invention it will be noted that even after use in considerable number of washings there will be little or no attack on the overglaze on china or little or no tarnishing of silver or silver plate as a result of the use of the detergent composition.

It will be apparent that many changes and modifications of the several features described herein may be made without departing from the spirit and scope of the invention. It is therefore apparent that the foregoing description is by way of illustration of the invention rather than limitation of the invention.

What is claimed is:

1. A water-soluble detergent composition capable of inhibiting overglaze attack consisting essentially of about 50-95% by weight of at least one water-soluble inorganic or organic builder salt and about 0.5–3.0% by weight of aluminum silicate, said aluminum silicate having a pH of about 5–9.

2. A composition in accordance with claim 1 which also includes about 0.5% to 5% by weight of a water soluble bleaching agent capable of liberating hypohalite in aqueous media.

3. A composition in accordance with claim 2, which also includes about 0.5% to 5% by weight of water soluble organic detergent selected from the group consisting of non-ionic, anionic, cationic and amphoteric detergents.

4. A composition in accordance with claim 1 wherein the inorganic builder comprises about 55–75% by weight of sodium tripolyphosphate hexahydrate and about 15–25% by weight of weight of sodium metasilicate.

5. A composition in accordance with claim 1 wherein the builder salt is selected from the group consisting of alkalimetal phosphates, silicates, carbonates, sulfates and salts of organic acids.

6. A method for treating glasses, dishes and like glazed surfaces to remove foreign bodies from the surfaces thereof without modifying the substrata comprising treating said substrata with a dilute aqueous solution of the composition defined in claim 1.

7. A method in accordance with claim 6, which also includes a rinsing step.

8. A water soluble detergent composition as defined in claim 1 wherein said aluminum silicate is precipitated aluminum silicate and has the general composition $Al_2O_3.7.8SiO_2$.

* * * * *